US008517188B2

(12) United States Patent
Kao

(10) Patent No.: US 8,517,188 B2
(45) Date of Patent: Aug. 27, 2013

(54) TOOL HANGER ASSEMBLY

(76) Inventor: Jui-Chien Kao, Tali (TW)

( * ) Notice: Subject to any disclaimer, the term of this patent is extended or adjusted under 35 U.S.C. 154(b) by 332 days.

(21) Appl. No.: 12/960,596

(22) Filed: Dec. 6, 2010

(65) Prior Publication Data

US 2012/0138553 A1 Jun. 7, 2012

(51) Int. Cl.
*A47F 7/00* (2006.01)
*A47F 5/08* (2006.01)

(52) U.S. Cl.
USPC ..... 211/70.6; 211/94.01

(58) Field of Classification Search
USPC ..... 211/70.6, 89.01, 84.01, 162, 70.8, 211/94.02, 66, 69, 94.01; 206/377, 378, 206/372, 349; 248/220.31
See application file for complete search history.

(56) References Cited

U.S. PATENT DOCUMENTS 1,712,473 A * 5/1929 McWethy ..... 206/378
4,209,098 A * 6/1980 Adams ..... 211/70.8
4,621,738 A * 11/1986 DeLucchi ..... 211/70.6
5,228,570 A * 7/1993 Robinson ..... 206/378
5,398,823 A * 3/1995 Anders ..... 211/70.6
5,544,747 A * 8/1996 Horn ..... 206/378
6,032,797 A * 3/2000 Kao ..... 206/378
6,070,745 A * 6/2000 Dembicks ..... 211/70.6
6,168,018 B1 * 1/2001 Ramsey et al. ..... 206/378
6,415,933 B1 * 7/2002 Kao ..... 211/70.6
6,431,373 B1 * 8/2002 Blick ..... 211/70.6
6,488,151 B2 * 12/2002 Ramsey et al. ..... 206/378
7,210,578 B2 * 5/2007 Tuan-Mu et al. ..... 206/378
7,669,723 B2 * 3/2010 Kao ..... 211/70.6
7,841,480 B2 * 11/2010 Hsieh ..... 211/70.6
8,152,003 B1 * 4/2012 Kao ..... 211/70.6
8,302,785 B2 * 11/2012 Kao ..... 211/70.6
8,302,786 B2 * 11/2012 Kao ..... 211/70.6
2003/0019775 A1 * 1/2003 Ernst ..... 206/378
2004/0144739 A1 * 7/2004 Marek ..... 211/70.6
2006/0207951 A1 * 9/2006 Wang ..... 211/70.6
2007/0017886 A1 * 1/2007 Kao ..... 211/94.01

* cited by examiner

*Primary Examiner* — Jonathan Liu
*Assistant Examiner* — Patrick Hawn
(74) *Attorney, Agent, or Firm* — Alan Kamrath; Kamrath IP Lawfirm, P.A.

(57) ABSTRACT

A tool hanger assembly has a frame and a hanger. The frame has a back plate and a bracket. The bracket is mounted securely on the back plate and has a track formed in a top of the bracket. The hanger is mounted securely on the frame and has a base plate and multiple pillars. The base plate is inserted securely in the track. The pillars are securely mounted on the base plate at intervals to allow sleeves to be mounted around. Accordingly, to assemble the hanger having the multiple pillars with the frame is quick, reduces assembling cost and is convenient.

10 Claims, 9 Drawing Sheets

TOOL HANGER ASSEMBLY

BACKGROUND OF THE INVENTION

1. Field of the Invention

The present invention relates to a tool hanger assembly and, more particularly, to a tool hanger assembly saving time for assembling.

2. Description of Related Art

A conventional tool hanger assembly has a frame and multiple hangers. The frame has a track formed in a side surface of the frame. The hangers are slidably mounted in the track, and each hanger has a seat protruding from the hanger. Each hanger has a pillar mounted securely on the seat to allow a sleeve to be mounted around.

However, the multiple hangers have to be slid into the track one by one, such that assembling the multiple hangers onto the frame is time-consuming, increases assembling cost and is not convenient.

Additionally, each hanger does not have a flat bottom surface, such that the conventional tool hanger assembly can only be hung on a display board and cannot be positioned on a flat surface.

To overcome the shortcomings, the present invention provides a tool hanger assembly to obviate the aforementioned problems.

SUMMARY OF THE INVENTION

The main objective of the present invention is to provide a tool hanger assembly saving time for assembling.

A tool hanger assembly has a frame and a hanger. The frame has a back plate and a bracket. The bracket is mounted securely on the back plate and has a track formed in a top of the bracket. The hanger is mounted securely on the frame and has a base plate and multiple pillars. The base plate is inserted securely in the track. The pillars are securely mounted on the base plate at intervals to allow sleeves to be mounted around. Accordingly, to assemble the hanger having the multiple pillars with the frame is quick, reduces assembling cost and is convenient.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
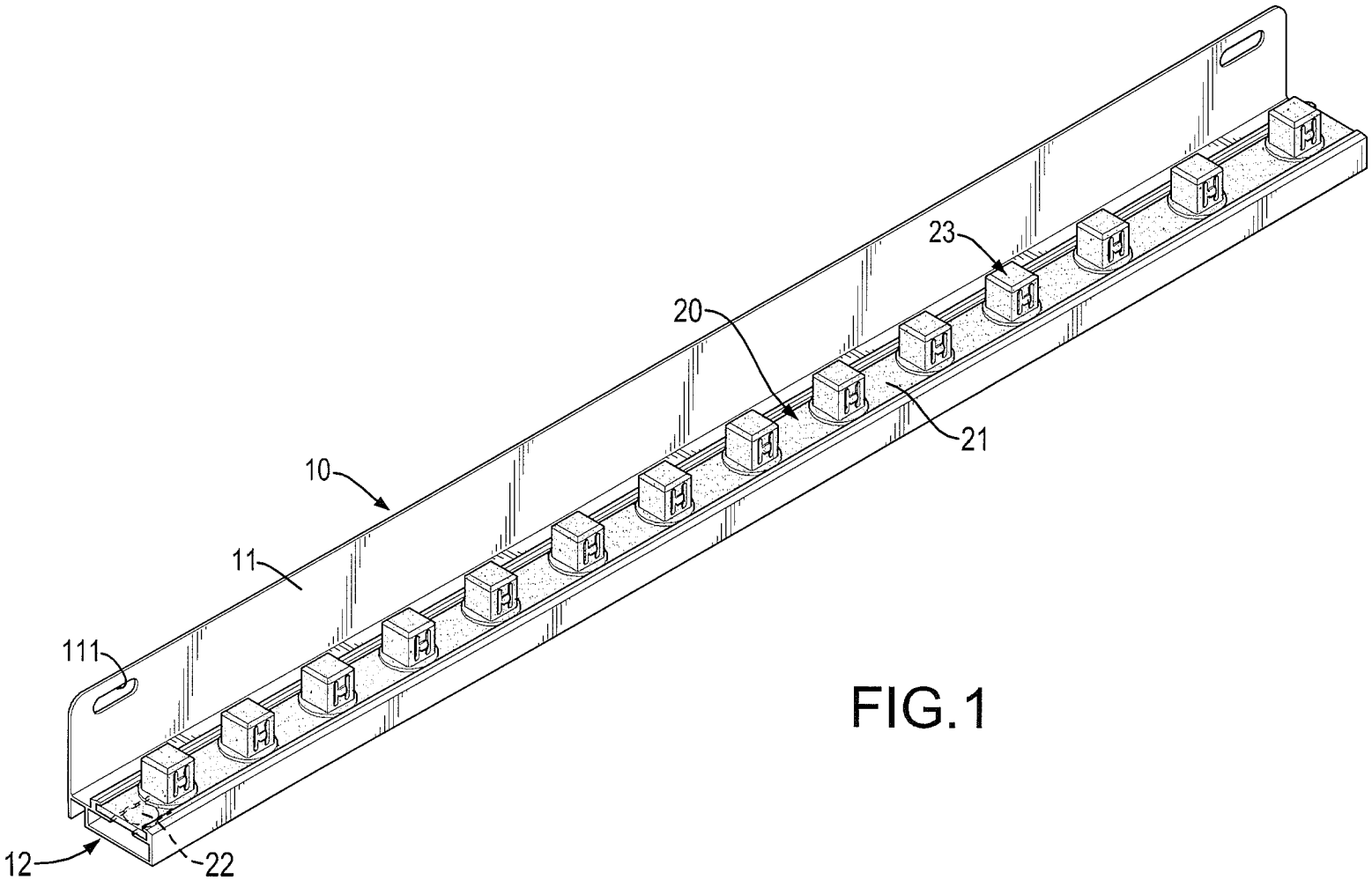
FIG. 1 is a perspective view of a tool hanger assembly in accordance with the present invention.
Figure 2:
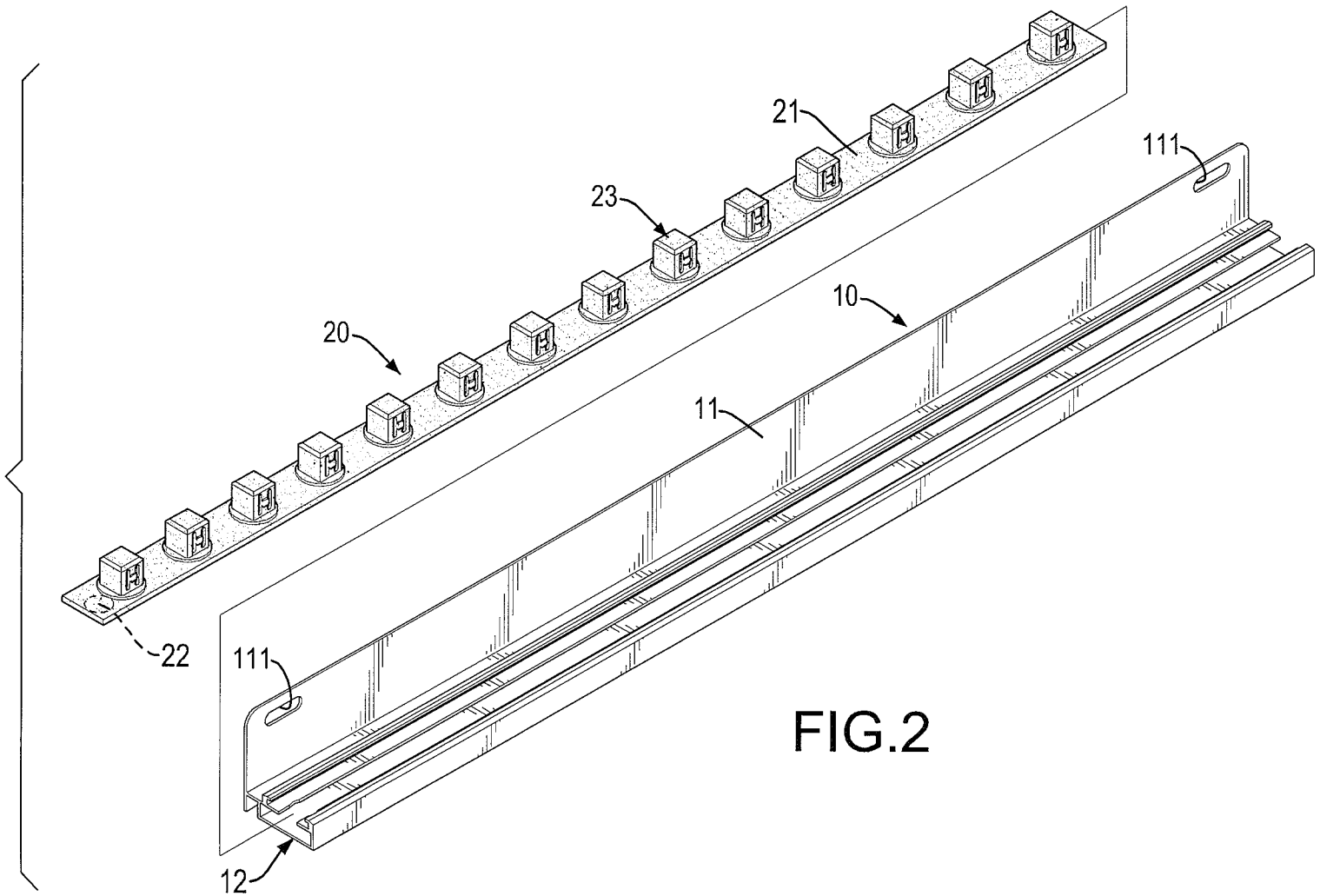
FIG. 2 is an exploded perspective view of the tool hanger assembly in FIG. 1.

With reference to FIGS. 1 to 5, a tool hanger assembly in accordance with the present invention comprises a frame 10 and a hanger 20.

The frame 10 is made of aluminum and has a back plate 11 and a bracket 12. The back plate 11 is elongated and has a side surface, a top, a bottom, two opposite ends and two mounting holes 111. The bottom of the back plate 11 is opposite to the top of the back plate 11. The mounting holes 111 are formed near the top and respectively near the opposite ends of the back plate 11.

The bracket 12 is elongated, is mounted securely on the back plate 11 and has a connecting plate 121, a seat plate 122, a front protrusion 123 and a back protrusion 124. The connecting plate 121 is mounted securely on the side surface near the bottom of the back plate 11 and has a distal portion opposite to the back plate 11.

The seat plate 122 is mounted securely on the distal portion of the connecting plate 121 and has two opposite ends, a rectangular cross section, a top section, a length, a bottom surface, an extending channel 1221, an opening 1222 and two concaves 1223. The length of the seat plate 122 is the same as that of the side surface of the back plate 11. The bottom surface of the seat plate 122 is flat and is located at a horizontal plane flush with the bottom of the back plate 11. The extending channel 1221 is formed inside the seat plate 122, is formed through the ends of the seat plate 122 and has a rectangular cross section.

The opening 1222 is formed in the top section of the seat plate 122, communicates with the extending channel 1221 and has a length the same as that of the back plate 11. The opening 1222 divides the top section of the seat plate 122 as a first segment and a second segment located between the first segment and the connecting plate 121.

The concaves 1223 are respectively formed in the first segment and the second segment of the top section of the seat plate 122, communicate with the opening 1222, align with each other and are adjacent to one of the ends of the seat plate 122.

The front protrusion 123 is formed on and protrudes upward from the first segment of the top section of the seat plate 122 and has a front rib 1231 protruding from the front protrusion 123.

The back protrusion 124 is formed on and protrudes upward from the second segment of the top section of the seat plate 122 and has a back rib 1241 protruding from the back protrusion 124. The front rib 1231 and the back rib 1241 face each other.

The track 125 is defined as a space between the front protrusion 123, the back protrusion 124 and the top section of the seat plate 122 and has a rectangular cross section.

The hanger 20 is made of plastic, is mounted securely on the frame 10 and has a base plate 21, a positioning button 22 and multiple pillars 23.

The base plate 21 is inserted securely into the track 125 and has a top and a bottom opposite to the top of the base plate 21.

Figure 6:
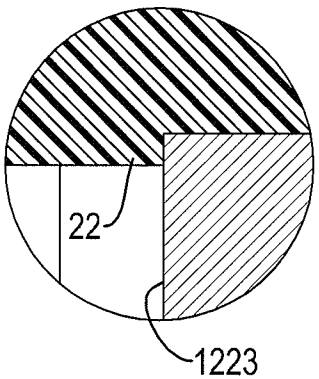
FIG. 6 is an enlarged view in partial section of the tool hanger assembly in FIG. 5.
Figure 5:
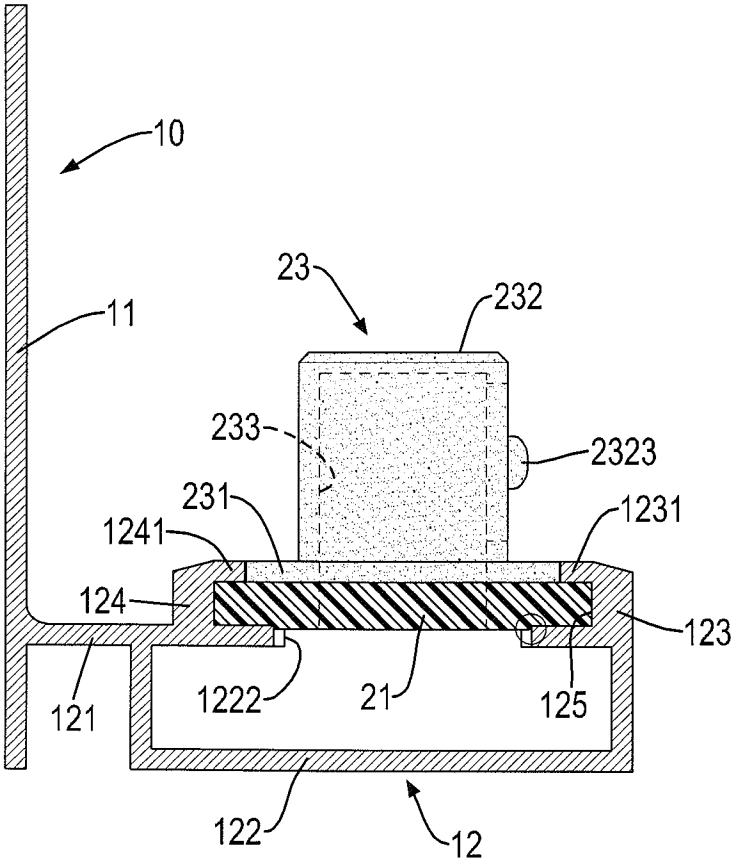
FIG. 5 is an enlarged side view in partial section of the tool hanger assembly in FIG. 1.

With further reference to FIG. 6, the positioning button 22 is round in section, is formed on the bottom of the base plate 21 and has two opposite sides respectively engaging the concaves 1223 and a thickness of 0.15 mm (millimeter). The thickness of the positioning button 22 may be the same as or half of that of the concaves 1223 to allow the positioning button 22 to be positioned in the concaves 1223.

The pillars 23 are formed on the top of the base plate 21 at intervals and are located between the front rib 1231 and the back rib 1241. Each pillar 23 has a support 231, a post 232 and a pillar hole 233. The supports 231 are mounted securely on the top of the base plate 21 at intervals, are located between the front rib 1231 and the back rib 1241 and respectively have a thickness the same as that of the front rib 1231. The posts 232 are respectively mounted securely on tops of the supports 231 and respectively have a square cross section.

The pillar holes 233 are respectively formed through the supports 231, are respectively formed in the posts 232 and respectively have a top.

Preferably, each post 232 has an aperture 2321, a tab 2322 and a knob 2323. The apertures 2321 are respectively formed through the posts 232, communicate with the tops of the pillar holes 233 and respectively have two opposite sides. The tabs 2322 are respectively mounted in the apertures 2321, are respectively connected with the opposite sides of the apertures 2321 and respectively have a central segment. The knobs 2323 are respectively mounted securely on the central segments of the tabs 2322 and protrude outwardly.

The pillars 23 may not have the pillar holes 233, the tabs 2322 and the knobs 2323 and still allow sleeves 30 to be mounted around in position. The present invention does not limit the format of the pillars 23.

Figure 7:
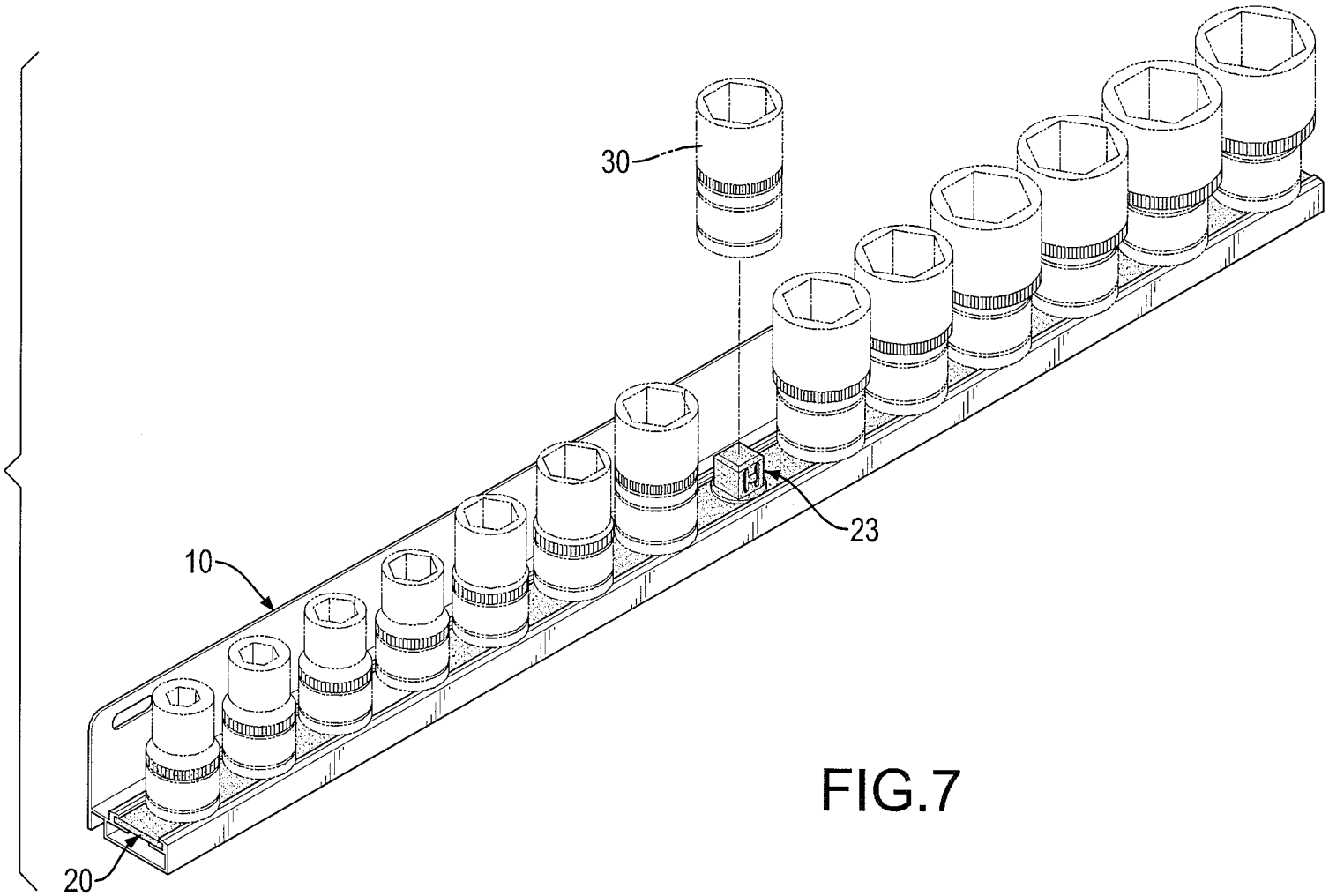
FIG. 7 is an operational perspective view of the tool hanger assembly in FIG. 1, with multiple sleeves respectively mounted around the pillars.
Figure 8:
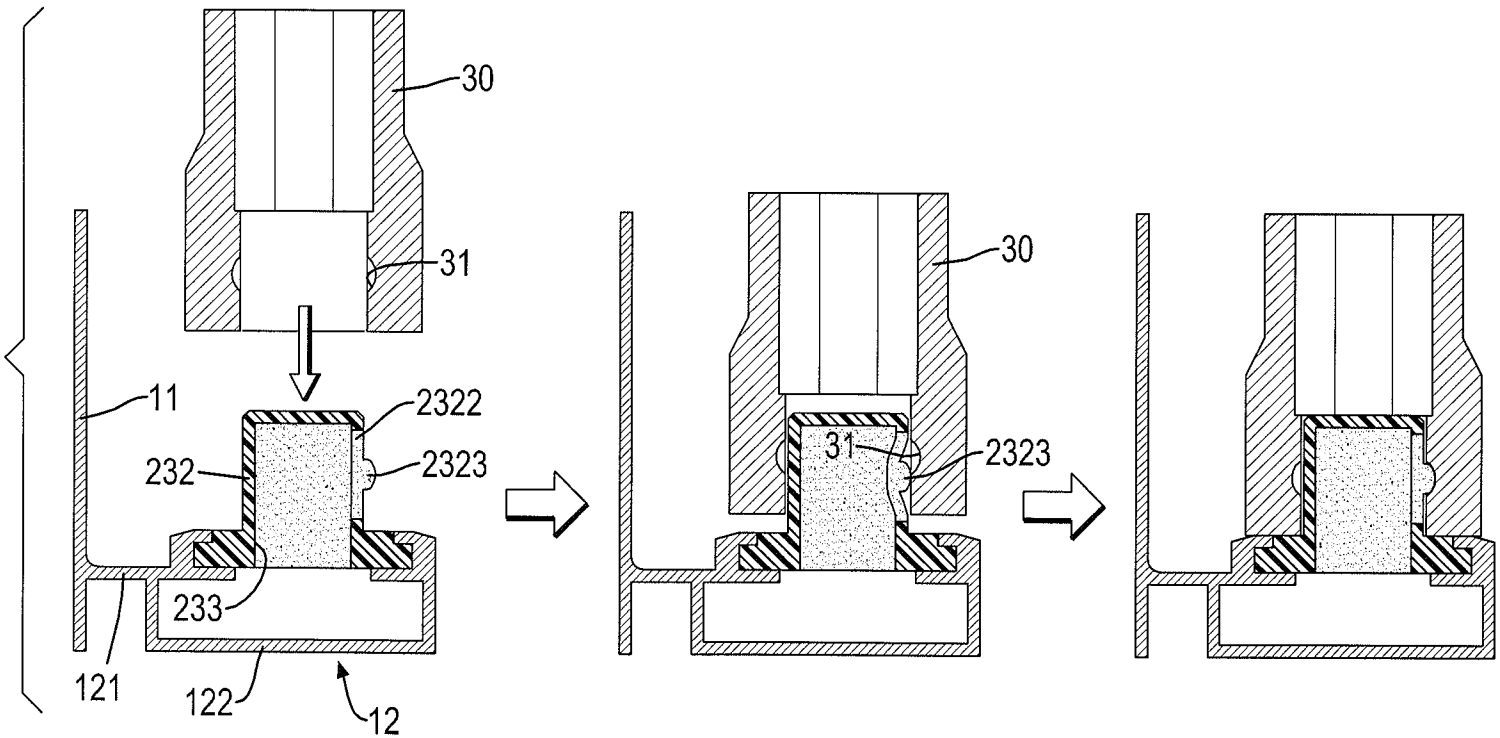
FIG. 8 shows operational cross sectional views of the tool hanger assembly, showing a process of mounting a sleeve around a pillar.

With reference to FIGS. 7 and 8, while the sleeves 30 are put on the tool hanger assembly in accordance with the present invention, inner surfaces of the sleeves 30 push the knobs 2323 inward of the pillar holes 233 and bend the tabs 2322. When the sleeves 30 are respectively mounted around the pillars 23, the tabs 2322 recover to push the knobs 2323 toward recesses 31 of the sleeves 30. Accordingly, with the knobs 2323 engaging the recesses 31 of the sleeves 30, the sleeves 30 can be mounted respectively around the pillars 23.

Figure 3:
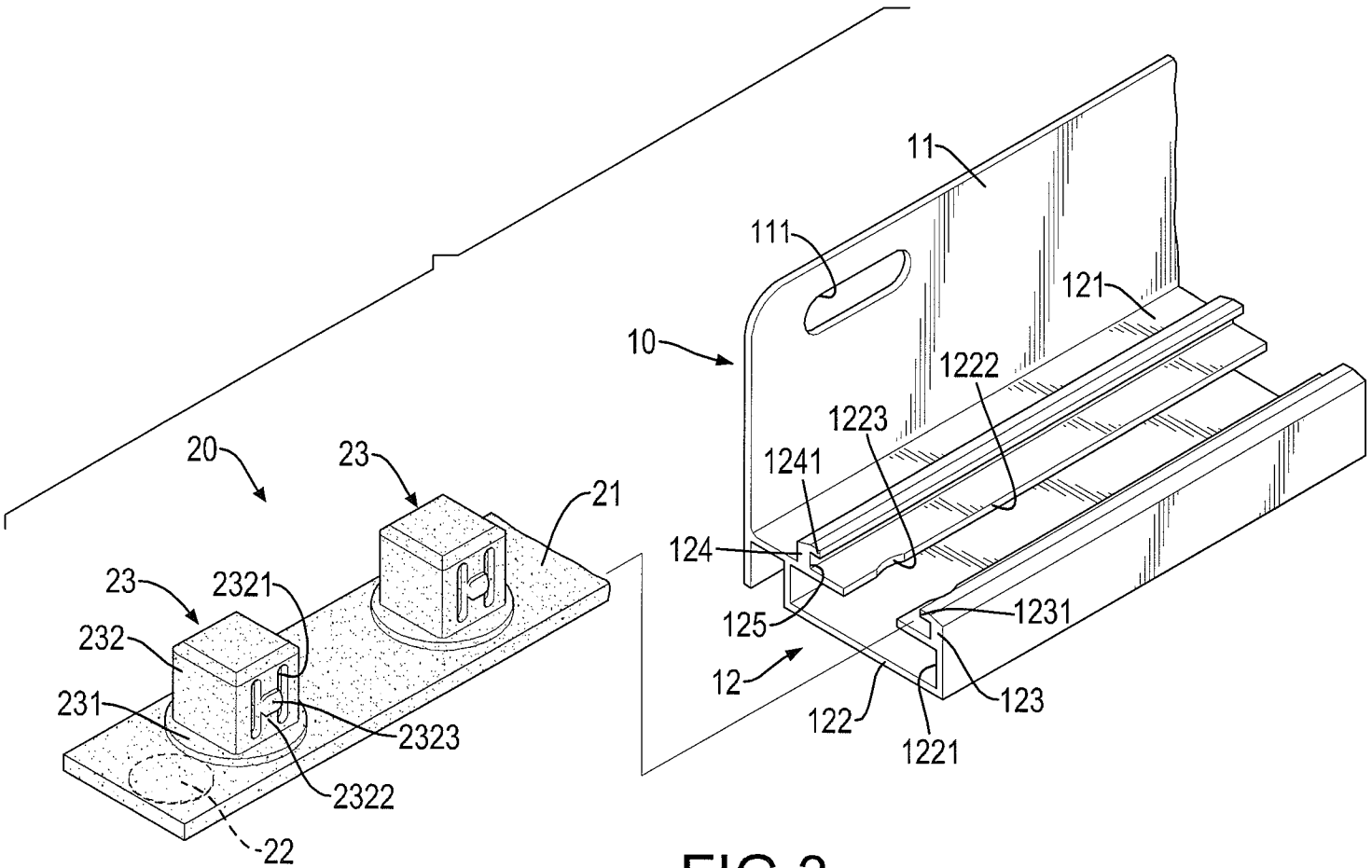
FIG. 3 is an enlarged exploded perspective view of the tool hanger assembly in FIG. 1.
Figure 4:
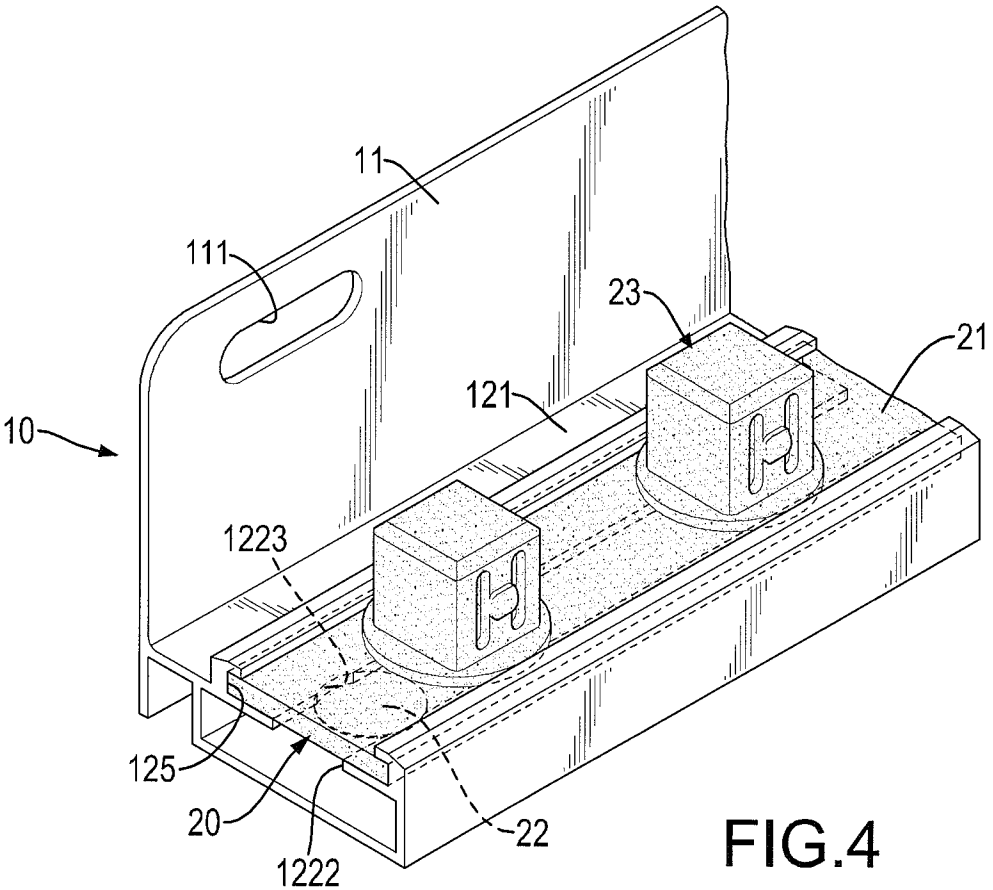
FIG. 4 is an enlarged perspective view of the tool hanger assembly in FIG. 1.

With reference to FIGS. 3 and 4, when the hanger 20 is assembled with the frame 10, the base plate 21 is inserted into the track 125 from one of the ends of the seat plate 122. Because the metallic frame 10 has the opening 1222, the metallic frame 10 has some resilience and tenacity to allow the positioning button 22 to be slid into the concaves 1223 in position. Because the positioning button 22 is easily slid into and off from the concaves 1223, the hanger 20 is easily assembled with and disassembled from the frame 10.

Figure 9:
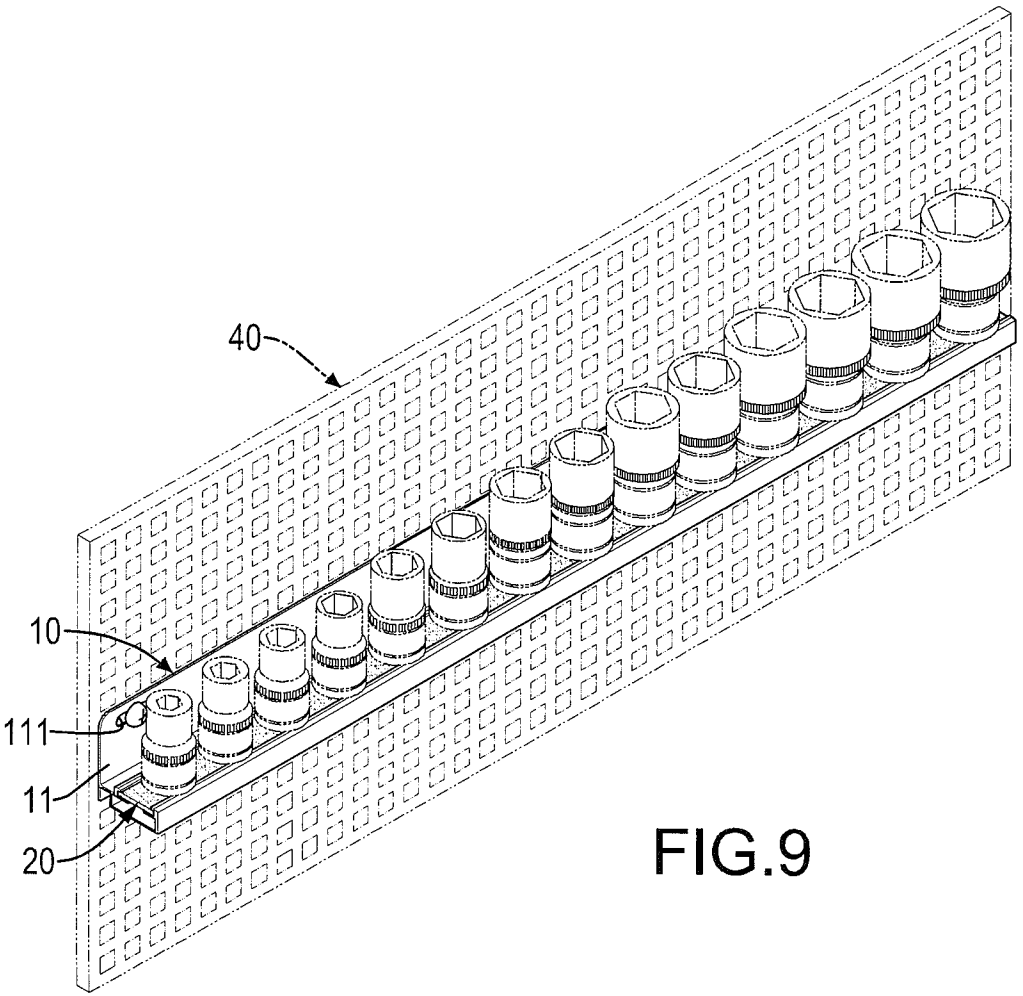
FIG. 9 is a perspective view of the tool hanger assembly, with the tool hanger assembly positioned onto a display board.
Figure 10:
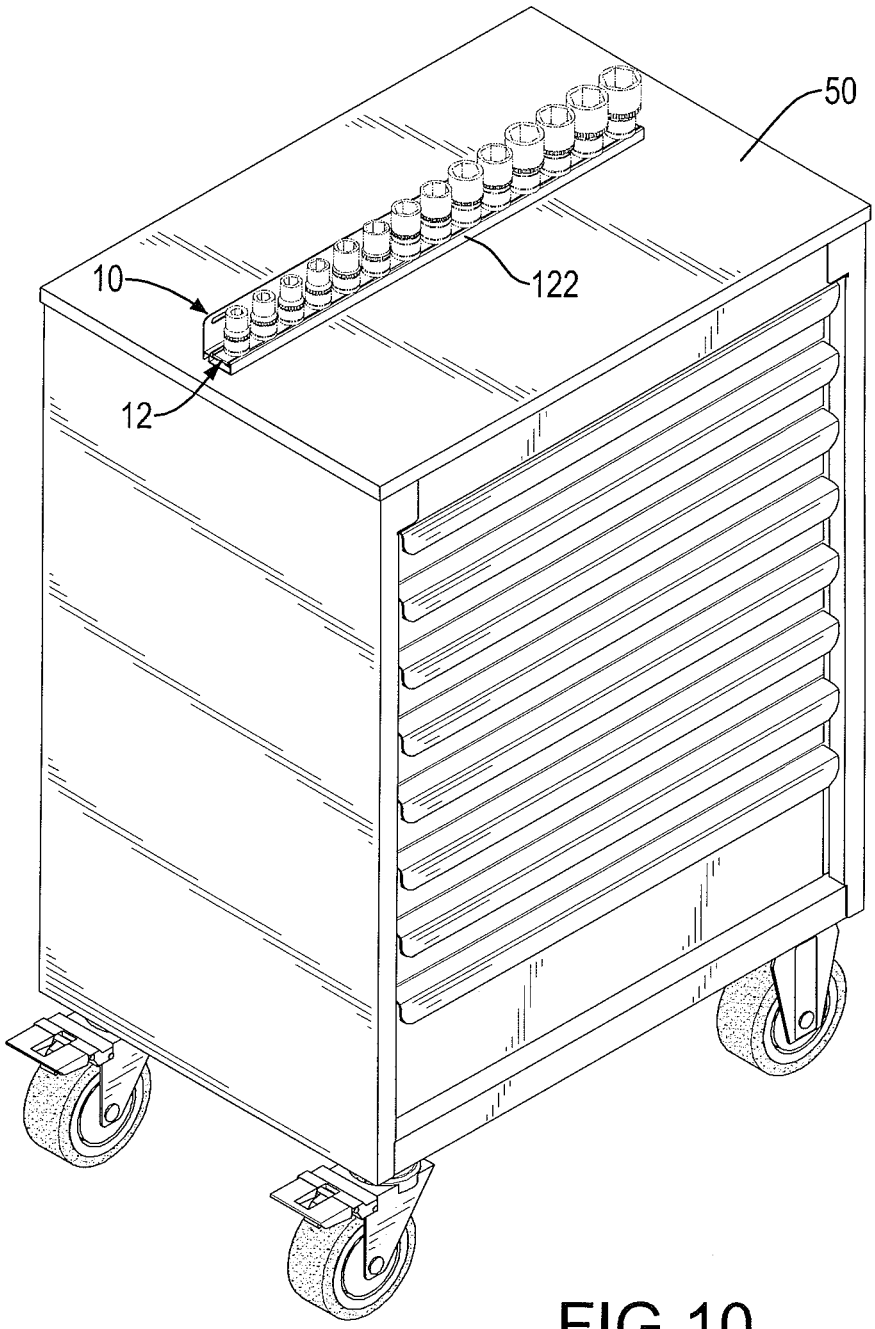
FIG. 10 is a perspective view of the tool hanger assembly, with the tool hanger assembly put on a top of a tool trolley.

With reference to FIG. 9, the tool hanger assembly in accordance with the present invention is hung onto a display board 40 by the mounting holes 111. With reference to FIG. 10, the bracket 12 is steadily put on a top of a tool trolley 50 because the bottom surface of the seat plate 122 of the bracket 12 is flat. Accordingly, the tool hanger assembly in accordance with the present invention can be conveniently positioned on any flat surface.

The hanger 20 with the multiple pillars 23 can hang the multiple sleeves 30. Because combining the hanger 20 having the multiple pillars 23 with the frame 10 is easy, to assemble the hanger 20 with the frame 10 is quick, reduces assembling cost and is convenient for hanging multiple sleeves 30.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tool hanger assembly comprising:
- a frame made of metal and having
  - an elongated back plate having
    - a top;
    - a bottom opposite to the top of the back plate
    - two opposite ends;
    - a side surface; and
    - two mounting holes formed near the top and respectively near the opposite ends of the back plate; and
  - an elongated bracket mounted securely on the back plate and having
    - a connecting plate mounted securely on the side surface near the bottom of the back plate and having a distal portion opposite to the back plate;
    - a seat plate mounted securely on the distal portion of the connecting plate and having
      - two opposite ends;
      - a rectangular cross section;
      - a top section;
      - a length the same as a length of the side surface of the back plate;
      - a flat bottom surface located at a horizontal plane flush with the bottom of the back plate;
      - an extending channel formed inside the seat plate, formed through the ends of the seat plate and having a rectangular cross section;
      - an opening formed in the top section of the seat plate, communicating with the extending channel and having a length the same as the length of the side surface of the back plate, wherein the opening divides the top section of the seat plate as a first segment and a second segment located between the first segment and the connecting plate; and
      - two concaves respectively formed in the first segment and the second segment of the top section of the seat plate, communicating with the opening, aligning with each other and adjacent to one of the ends of the seat plate;
    - a front protrusion formed on and protruding upward from the first segment of the top section of the seat plate and having a front rib protruding from the front protrusion;
    - a back protrusion formed on and protruding upward from the second segment of the top section of the seat plate and having a back rib protruding from the back protrusion, wherein the front rib and the back rib face each other; and
    - a track defined as a space between the front protrusion, the back protrusion and the top section of the seat plate; and
- a hanger made of plastic and mounted securely on the frame and having
  - a base plate inserted securely into the track and having a top and a bottom opposite to the top of the base plate;
  - a positioning button formed on the bottom of the base plate and having two opposite sides respectively engaging the concaves; and
  - multiple pillars formed on the top of the base plate at intervals and located between the front rib and the back rib.

2. The tool hanger assembly as claimed in claim 1, wherein each pillar has a support mounted securely on the top of the base plate, located between the front rib and the back rib and having a top and a thickness the same as that of the front rib; and a post mounted securely on the top of the support and having a square cross section.

3. The tool hanger assembly as claimed in claim 2, wherein each pillar has a pillar hole;

the pillar hole is formed through the support of the pillar, is formed in the post of the pillar and has a top; and each post has an aperture formed through the post, communicating with the top of the pillar hole in the post and having two opposite sides;

a tab mounted in the aperture, connected with the opposite sides of the aperture and having a central segment; and a knob mounted securely on the central segment of the tab and protruding outwardly.

4. The tool hanger assembly as claimed in claim 1, wherein the positioning button is round in section and has a thickness of 0.15 mm (millimeter).

5. The tool hanger assembly as claimed in claim 2, wherein the positioning button is round in section and has a thickness of 0.15 mm (millimeter).

6. The tool hanger assembly as claimed in claim 3, wherein the positioning button is round in section and has a thickness of 0.15 mm (millimeter).

7. The tool hanger assembly as claimed in claim 1, wherein the connecting plate, the top section, and the flat bottom surface extend perpendicular to the side surface, and wherein the connecting plate and the top section is intermediate and spaced from the top and the bottom of the back plate.

8. The tool hanger assembly as claimed in claim 1, wherein the length of the side surface of the back plate comprises the length of the side surface of the back plate parallel to the side surface and between the two opposite ends of the back plate, wherein the length of the seat plate comprises the length of the seat plate parallel to the side surface and between the two opposite ends of the seat plate, and the length of the opening comprises the length of the opening parallel to the side surface and between the two opposite ends of the seat plate.

9. The tool hanger assembly as claimed in claim 1, wherein the opening extends between the two opposite ends of the seat plate.

10. The tool hanger assembly as claimed in claim 1, wherein the two concaves are located intermediate and spaced from the two opposite ends of the seat plate.

* * * * *